US007242858B1

(12) United States Patent
Welch et al.

(10) Patent No.: US 7,242,858 B1
(45) Date of Patent: Jul. 10, 2007

(54) EXTERNAL RESET DEVICE FOR AN ELECTRIC WATER HEATER

(75) Inventors: Richard E. Welch, Lexington, OH (US); Michael L. Miller, Huntersville, NC (US)

(73) Assignee: Therm-O-Disc Incorporated, Mansfield, OH (US)

( * ) Notice: Subject to any disclaimer, the term of this patent is extended or adjusted under 35 U.S.C. 154(b) by 0 days.

(21) Appl. No.: 11/374,620

(22) Filed: Mar. 13, 2006

(51) Int. Cl.
*F24H 1/20* (2006.01)

(52) U.S. Cl. ..... 392/455; 392/441; 361/816

(58) Field of Classification Search ..... None
See application file for complete search history.

(56) References Cited

U.S. PATENT DOCUMENTS 4,055,724 A * 10/1977 Manecke et al. ..... 174/66
4,554,616 A 11/1985 McIntosh
4,641,223 A 2/1987 McIntosh
5,391,834 A 2/1995 Place
5,398,168 A * 3/1995 Berestecky ..... 361/816
5,949,960 A * 9/1999 Hall ..... 392/454
6,363,216 B1 * 3/2002 Bradenbaugh ..... 392/463
2002/0188382 A1 * 12/2002 Sherwood ..... 700/282
2003/0214416 A1 * 11/2003 Diaz-Lopez ..... 340/690

* cited by examiner

*Primary Examiner*—Thor Campbell
(74) *Attorney, Agent, or Firm*—Harness, Dickey & Pierce, PLC

(57) ABSTRACT

An external reset device that is operable in combination with an electric water heater is disclosed. The external reset device is attached to an element cover that is mounted to the water heater and conceals the water heater's control device, such as a manual reset thermostat. The external reset device comprises a bushing member and a key member attached to the element cover. The bushing member is aligned with a reset button on the control device. The key member is adapted for insertion into the bushing member to depress the reset button and close a switch, enabling the heating elements of the electric water heater to power ON and heat the water within the electric water heater.

19 Claims, 6 Drawing Sheets

EXTERNAL RESET DEVICE FOR AN ELECTRIC WATER HEATER

BACKGROUND

The present disclosure relates to an electric water heater, and more specifically to an external reset device for resetting a control for the electric water heater.

Generally speaking, electric water heaters include a control device that has override control over the current powering the water heater's heating elements. When electric water heaters are manufactured and shipped from the factory to consumers for initial installation, the control device is configured such that the electric circuit containing the heating elements is OPEN. As such, one step in the installation of electric water heaters is to reset the control device to CLOSE the circuit and enable the heating elements to be powered ON.

Before the heating elements are first powered ON for the first time, however, it is necessary to fill the water heater tank with an initial charge of water. This is so because without the heat sink that is provided by water surrounding the water heater's heating elements, the heating elements will burn out and become unusable very quickly (e.g., in about 3 to 4 seconds). Unfortunately, it is all too common an occurrence during electric water heater installations that the water heater tank is not first filled with the initial charge of water prior to resetting the control device and powering ON the heating elements. This condition, known as "dry start," consequently, results in damage to the water heater and its heating elements. Water heater manufacturers, then, are subjected to undesirable customer complaints and warranty claims.

Therefore, it is desirable to design an apparatus for an electric water heater which discourages and/or prevents the occurrence of dry start by impeding the operation of the heating elements until the operator acknowledges that the water heater tank receives an initial charge of water.

The statements in this section merely provide background information related to the present disclosure and may not constitute prior art.

SUMMARY

In accordance with the present invention, an external reset device is provided which is operable in combination with an electric water heater of the type having a control device, such as a manual reset thermostat device having a reset button, being electrically coupled to the electric water heater's heating elements. The external reset device is operable to reduce the occurrence of dry start by preventing the operation of the heating elements until the operator takes the affirmative step of manually utilizing the external reset device to reset the control device.

The external reset device is attached to an element cover that is mounted to the water heater. The element cover includes a feature that defines a first aperture. The element cover is adapted to be attached to an exterior surface of the electric water heater while concealing the water heater's control device. The first aperture of the element cover is positioned adjacent to the control device. Additionally, the external reset device comprises a bushing member and a key member both removably coupled to the element cover. The bushing member, which has a feature defining a second aperture, is positioned adjacent to the first aperture of the element cover and aligned with the control device. The key member is adapted for insertion into the second aperture of the bushing member to depress a reset button or other mechanism on the control device to enable the heating elements to power ON and heat the water within the electric water heater.

When used in combination with a conventional electric water heater, the present invention provides the potential for reducing the opportunity for the occurrence of dry start during installation of the water heater.

The present invention further enables installers and operators of the electric water heater to reset the water heater's control device without having to remove the element cover and being exposed to the electric water heater's wiring.

It is expected that the present invention will reduce field failures and warranty returns for electric water heaters and their components, particularly the heating elements, and thereby achieve cost savings and increased customer satisfaction.

Further areas of applicability will become apparent from the description provided herein. It should be understood that the description and specific examples are intended for purposes of illustration only and are not intended to limit the scope of the present disclosure.

BRIEF DESCRIPTION

The drawings described herein are for illustration purposes only and are not intended to limit the scope of the present disclosure in any way.

DETAILED DESCRIPTION

Figure 1:
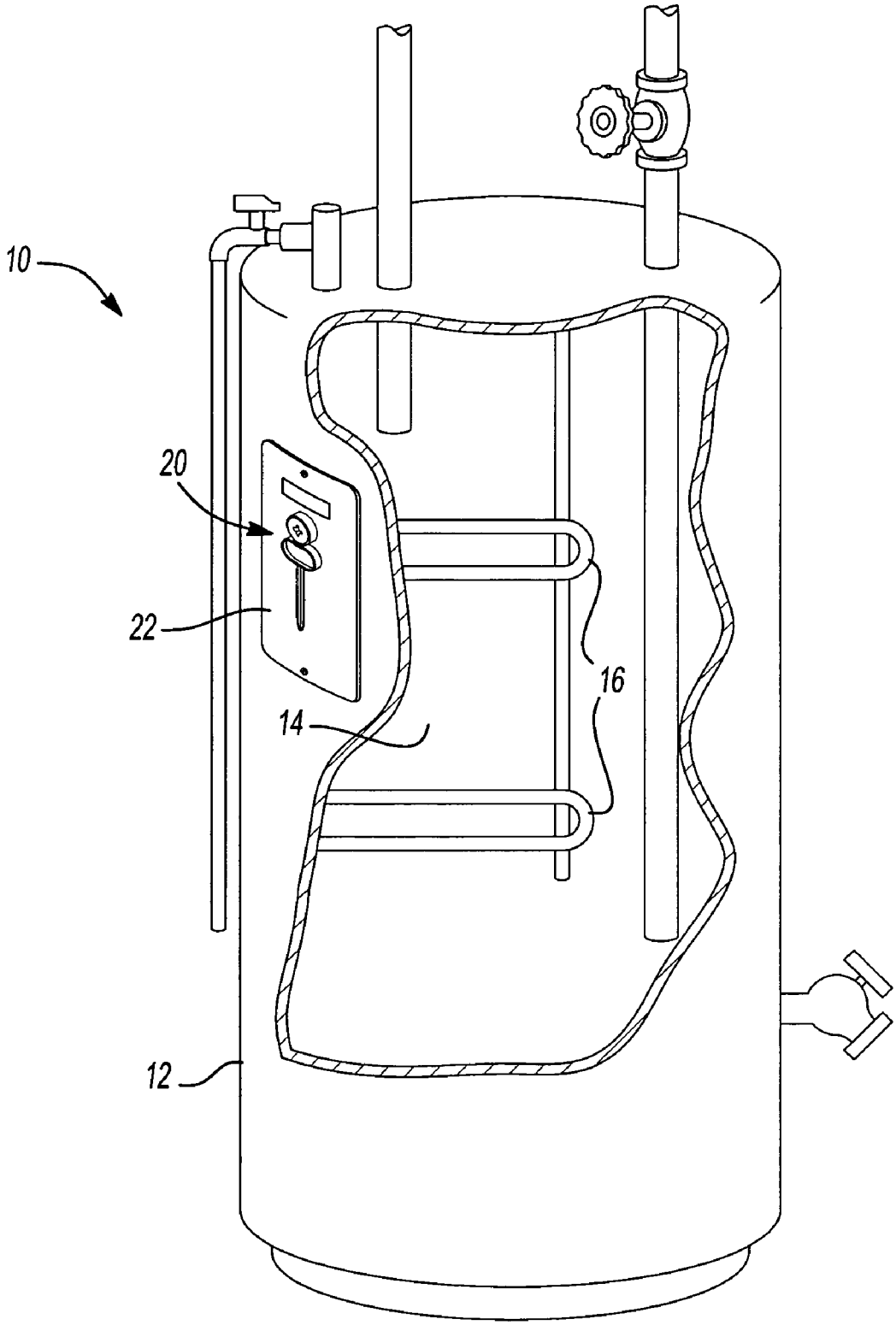
FIG. 1 is a perspective view of an exemplary electric water heater that is incorporating an external reset device according to the present invention.
Figure 2:
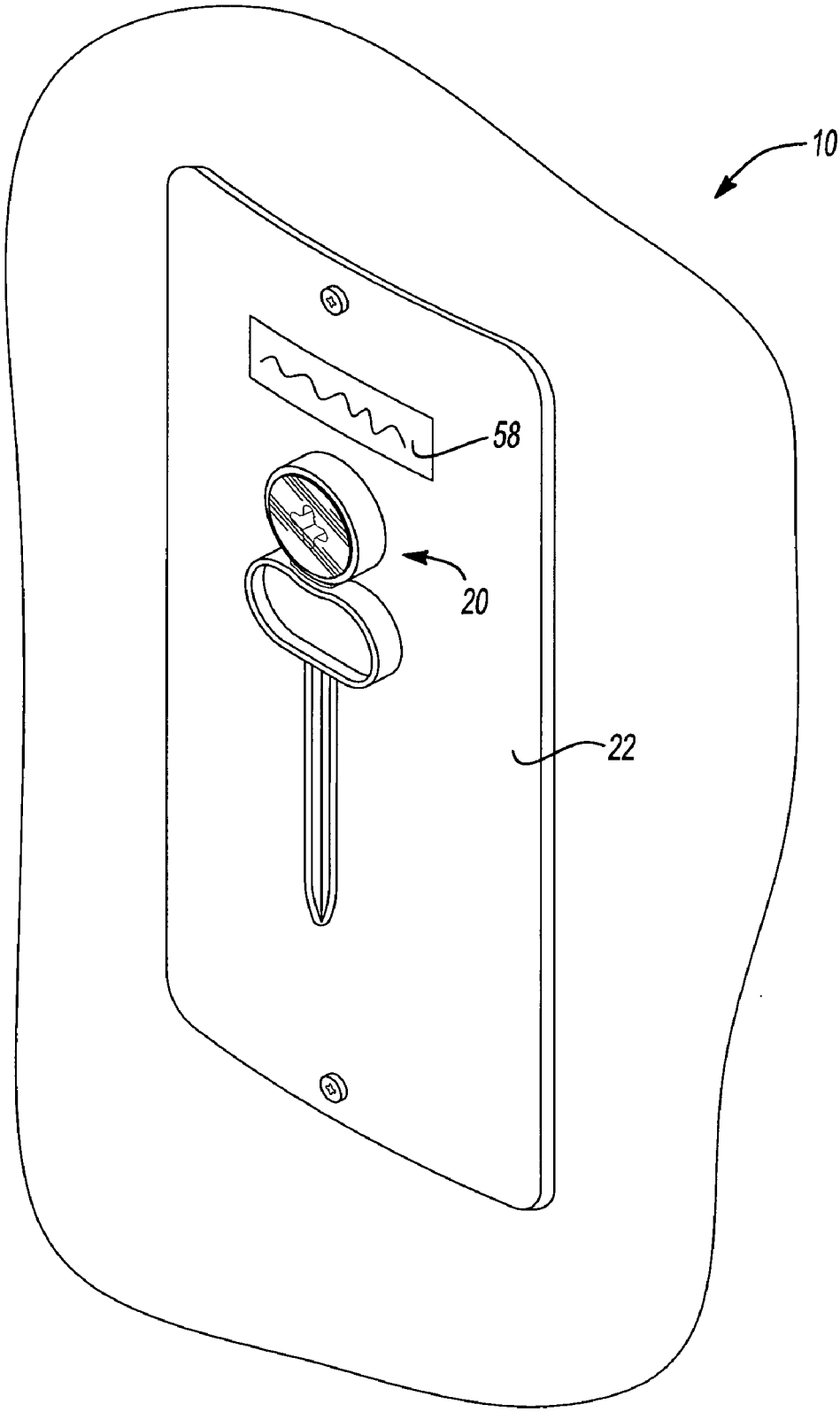
FIG. 2 is an enlarged perspective view of a portion of the electric water heater of FIG. 1.

The following description is merely exemplary in nature and is not intended to limit the present disclosure, application, or uses. It should be understood that throughout the drawings, corresponding reference numerals indicate like or corresponding parts and features.

Referring to FIGS. 1–5, an apparatus 10 comprises an electric water heater 12, an element cover 22 and an external reset device 20. The element cover 22 is coupled or attached to the electric water heater 12. The external reset device 20 is, in turn, coupled to the element cover 22.

The electric water heater 12 includes one or more heating elements 16 and a control device 18 as illustrated in the Figures. The heating elements 16 are, for example, electrically powered resistance heaters and are operable to heat the water contained within the electric water heater 12. The heating elements 16 are electrically coupled to the control device 18.

The control device 18 is illustrated as a manual reset thermostat device 18, which comprises a switch having a normally CLOSED position and an OPEN position. Any suitable control device may be used. A preferred control device for use with the present invention is a 66T series control that is available from Therm-O-Disc, Incorporated of Mansfield, Ohio. When in the normally CLOSED position, the control device 18 is operable to enable power to be supplied to the heating elements 16. When in the OPEN position, the control device 18 disables the power supplied to the heating elements 16. The control device 18 also includes a reset button 54. When depressed, the reset button 54 is operable to reset the control device 18 from the OPEN position to the normally CLOSED position.

Figure 5:
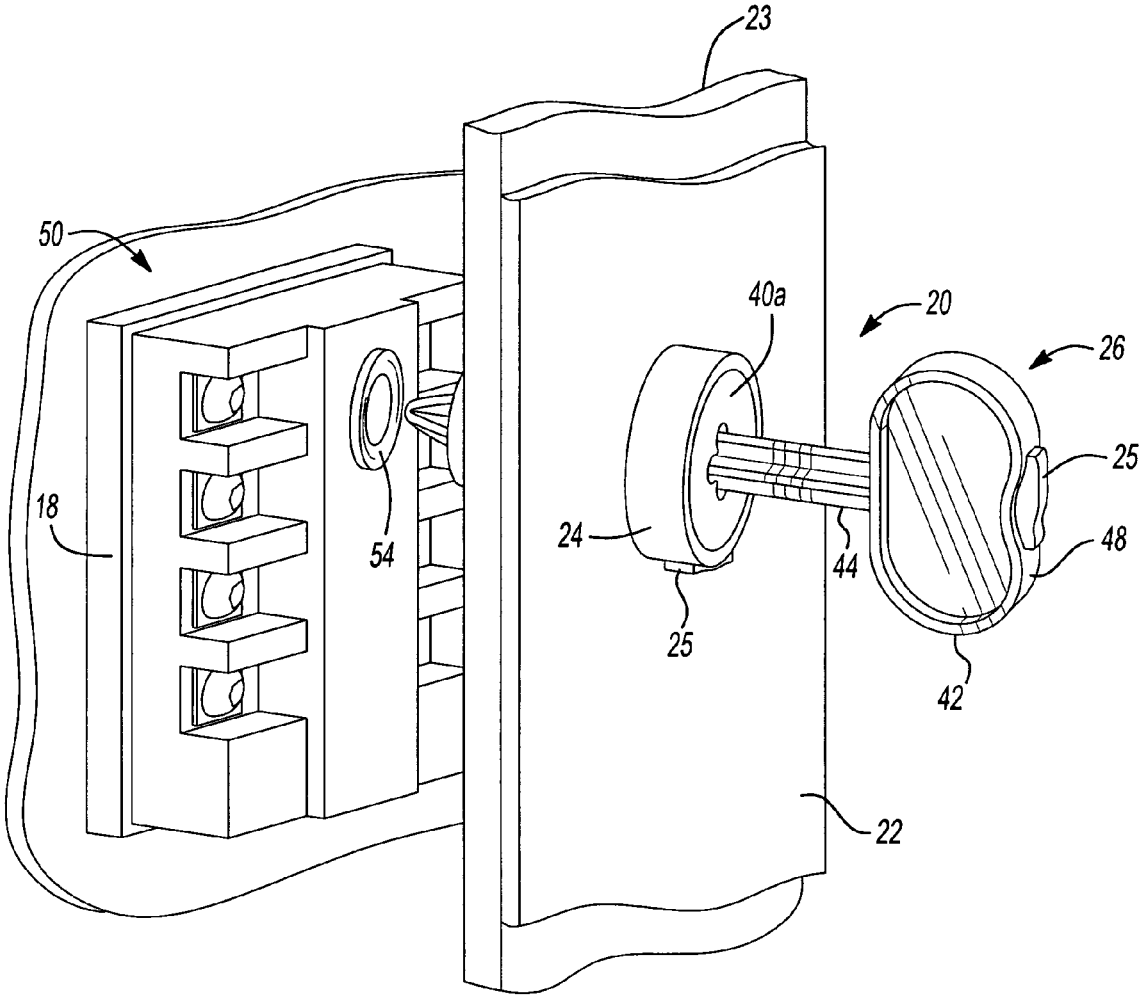
FIG. 5 is a perspective view of the external reset device of the present invention during use and shown with a portion of the exterior surface of the water heater removed.
Figure 5A:
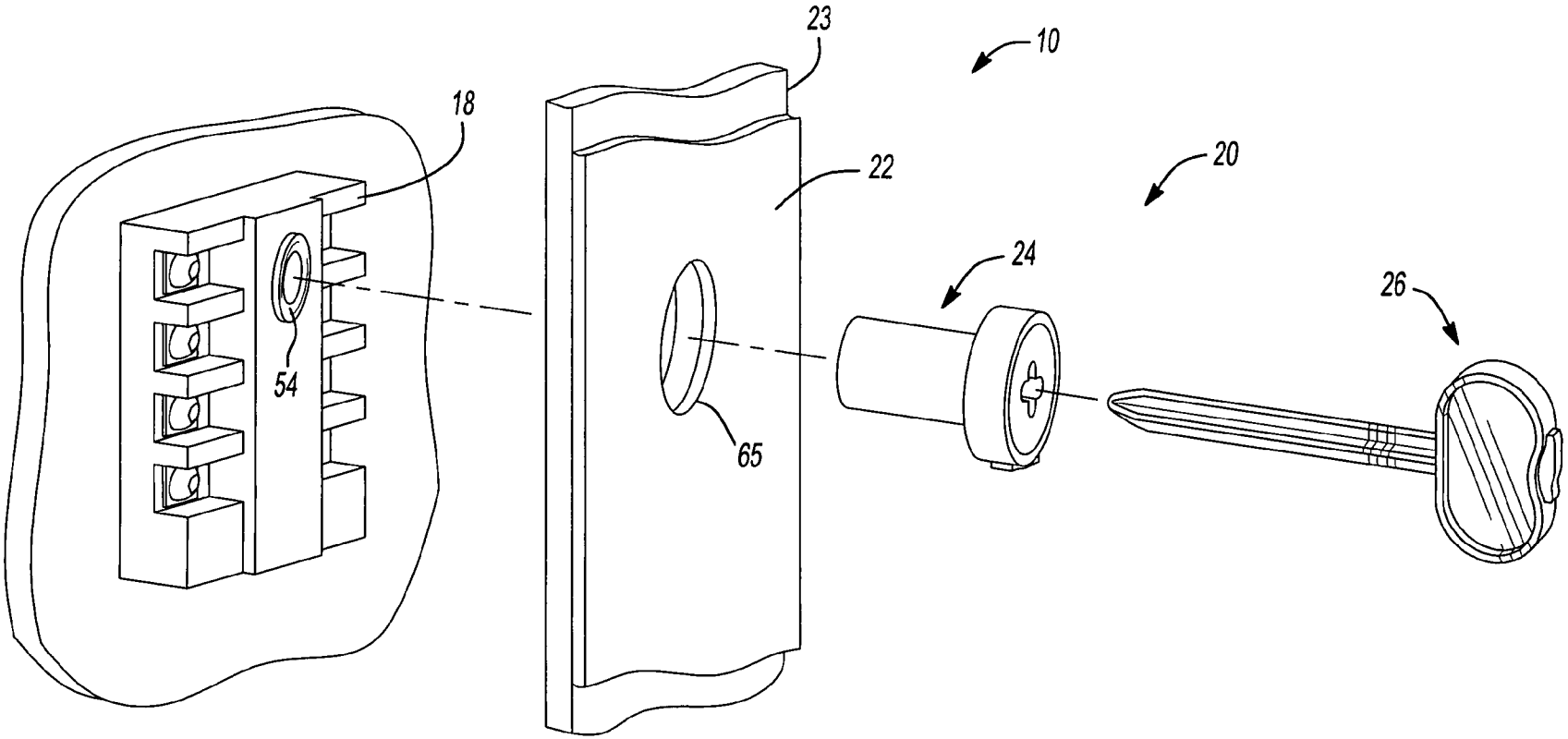
FIG. 5A is an exploded perspective view of a portion of the electric water heater having the external reset device in accordance with the present invention.

As is known in the art, the electric water heater 12 further comprises a plastic shield 23, commonly called a personnel protection cover, for covering the electrical connections of the water heater so that unintended contact with the connections and water heater components is avoided. (See FIG. 5). The plastic shield 23 is coupled to the electric water heater 12 and conceals the control device 18 and its exposed electrical connections. Referring to FIG. 5A, an aperture 27 included in the plastic shield 23 enables access to the reset button 54 without its removal. Additionally, the plastic shield 23 is positioned between the control device 18 and the element cover 22, such that the element cover 22 lies adjacent to the plastic shield 23 (see FIGS. 5 and 5A).

Referring again to FIG. 5, the element cover 22 of the electric water heater 12 is operative to conceal the plastic shield 23. The element cover 22 includes a feature defining a cover aperture 65, such that the bushing member 24 is coupled to the element cover 22 by inserting the column portion 30 through the cover aperture 65. The shape and diameter of the cover aperture 65 is configured to correspond to that of the column portion 30.

Figure 3:
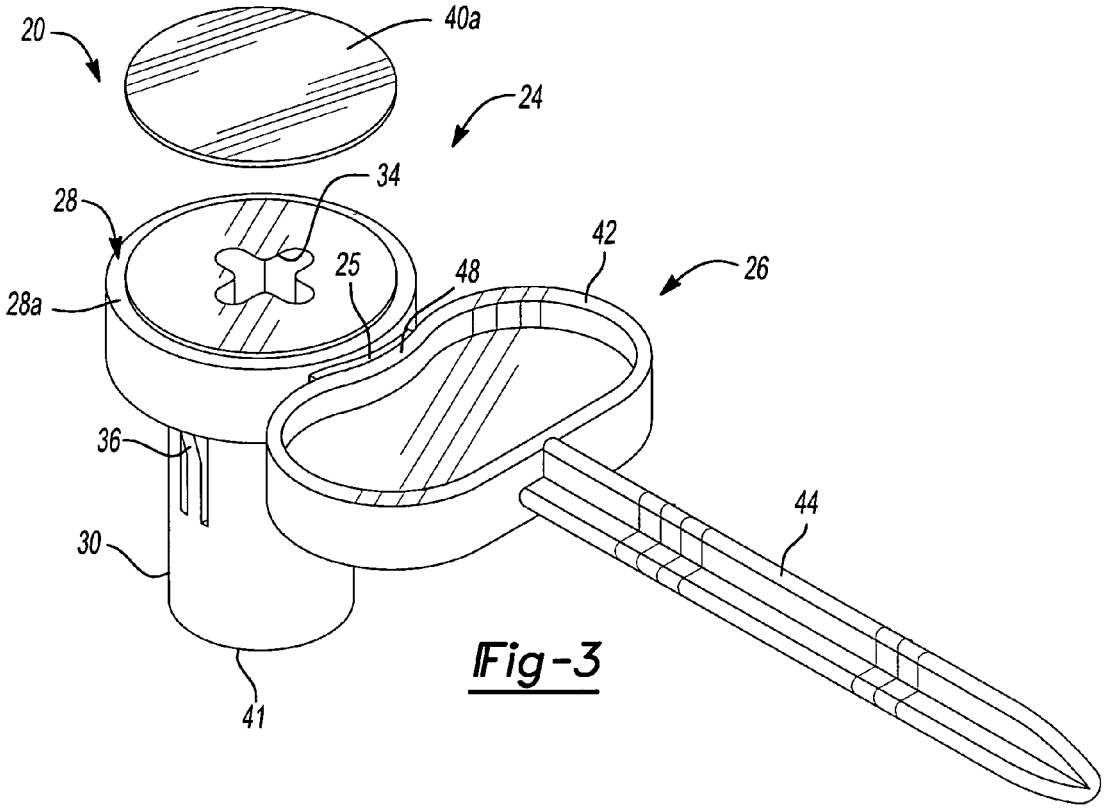
FIG. 3 is a back-side view of one embodiment of the external reset device of the present invention.
Figure 4:
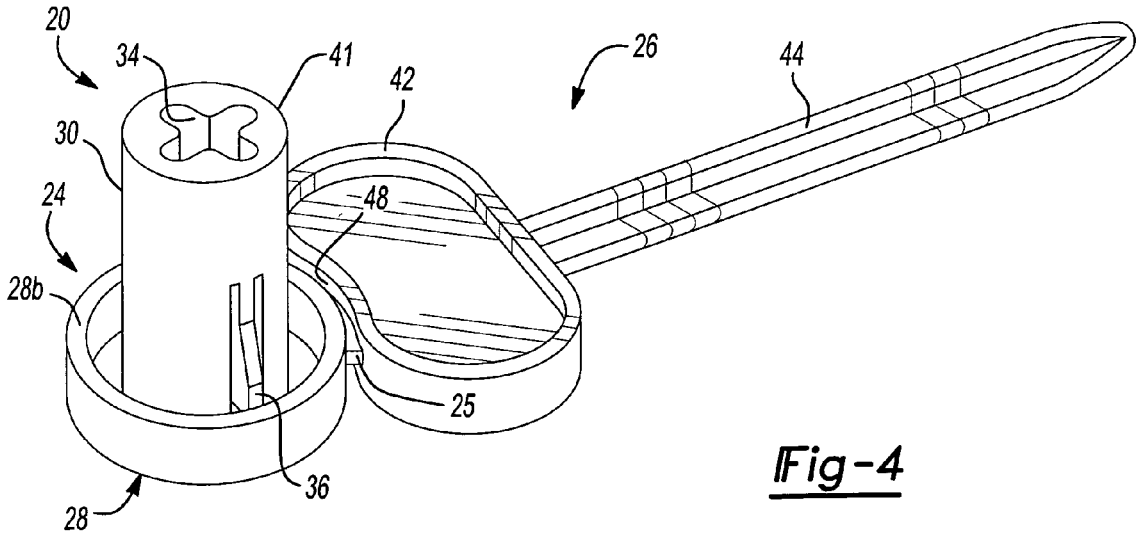
FIG. 4 is a front-side view of the device of FIG. 3.

Referring to FIGS. 3 and 4, the external reset device 20 comprises a bushing member 24 and a key member 26. The bushing member 24 is coupled to the key member 26 at a thin neck portion 25. The bushing member 24 comprises a top portion 28 and a column portion 30. The top portion 28 is coupled to the column portion 30. The top portion 28 comprises an upper side 28*a* and a bottom side 28*b* and may have a cylindrical shape. The upper side 28*a* has a planar surface, and the bottom side 28*b* may comprise a socket shape. Additionally, the top portion 28 has a feature defining a bushing aperture 34 that continues over a length of the column portion 30. The column portion 30 extends and is coupled to the bottom side 28*b* of the top portion 28. Additionally, the column portion 30 has at least two protruding clips 36 used to hold and maintain the bushing member 24 in place after the bushing member 24 is installed to the element cover 22 of the electric water heater 12. The protruding clips 36 may be located on opposing sides of the column portion 30. Moreover, the protruding clips 36 flex inward for easy installation as the bushing member 24 may be inserted through the aperture 65 of the element cover 22.

As shown in FIG. 3, the bushing member 24 may further comprise a first film cover 40*a* located upon a surface of the top portion 28. The first film cover 40*a* is adapted to be pierced as the key member 26 is inserted into the bushing member 24.

Again referring to FIGS. 3 and 4, the key member 26 comprises a handle portion 42 and an extension portion 44. The extension portion 44 may comprise at least one groove and/or at least one notch, such that the extension portion 44 is grooved and notched to correspond to a shape and size of the bushing aperture 34. Additionally, the handle portion 42 may include a curved recess 48. As shown in FIG. 5, while inserted into the bushing member 24, the key member 26 is adapted to depress the reset button 54.

FIG. 5A shows an exploded view display of the external reset device 20 which is in insertion relation to the element cover 22 and the plastic cover 23 associated with the electric water heater 10. More specifically, the key member 26 is in insertion relation to the bushing member 24 that is in insertion relation to element cover 22 of the electric water heater 10. The dot-dash lines extending along an axis A of the parts mentioned indicate the insertion position of the external reset device 20 into the element cover 22 for resetting the control device 18.

The external reset device 20 may comprise a plastic or metal material, or a combination of both, such that the external reset device 20 is molded and configured in accordance to the description contained herein.

Figure 6:
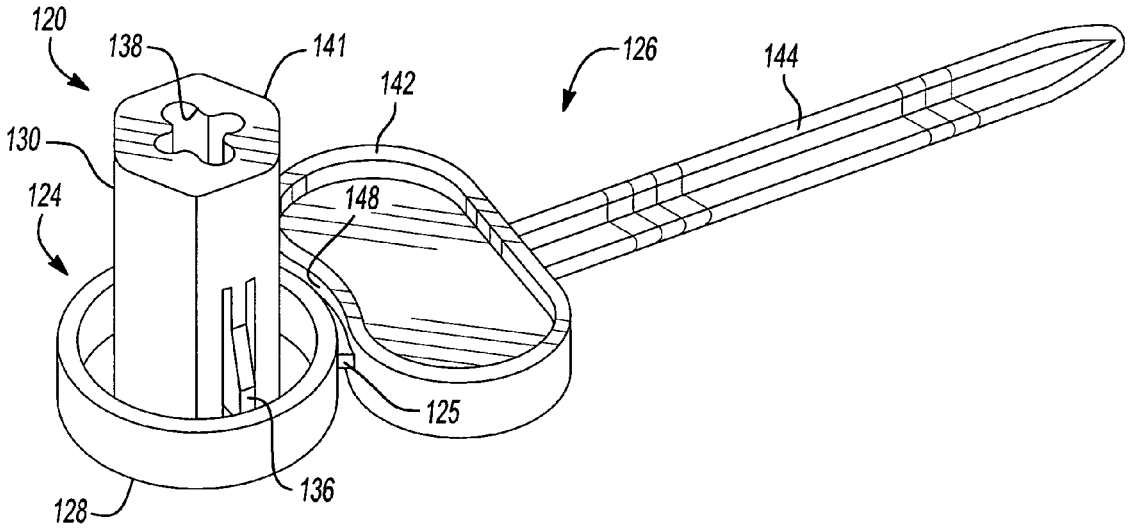
FIG. 6 is a front-side view of an alternative embodiment of the external reset device of the present invention.

With reference to FIG. 6, a first alternative embodiment of the external reset device of the present invention is shown and generally referred to at reference number 120. The external reset device 120 includes a bushing member 124 having a column portion 130. An outer parameter of the column portion 130 is adapted to position the bushing member 124 into the element cover 122 in a desired and proper orientation. In one example, the outer parameter of the column portion 130 may define a hexagonal shape.

Figure 7:
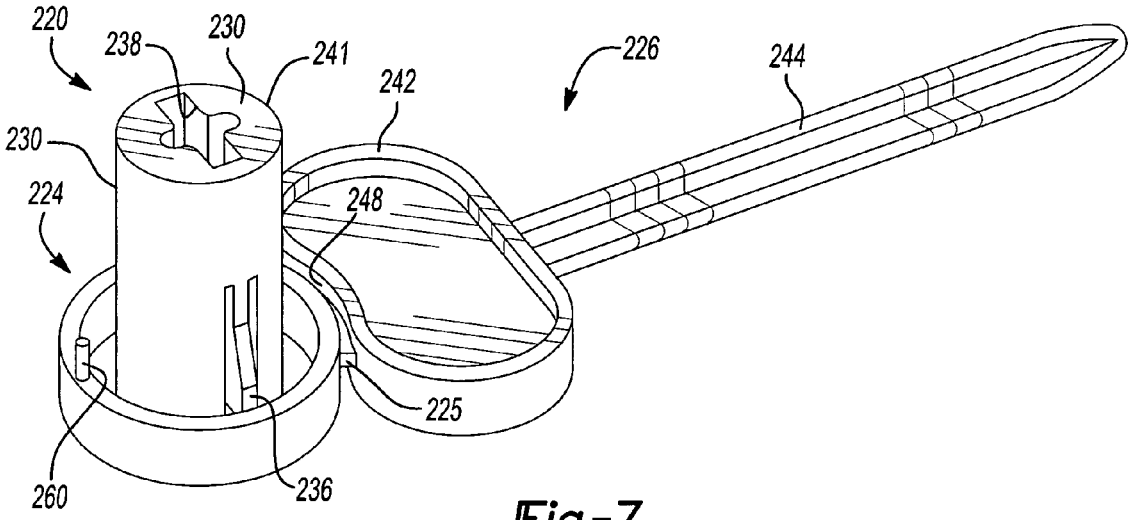
FIG. 7 is a front-side view of another alternative embodiment of the external reset device of the present invention.

Turning now to FIG. 7, an external reset device 220 according to a second alternative embodiment of the present invention is shown. Like components have been identified with like reference numbers. An alignment pin 260 is located at the top portion 228 of the bushing member 214, such that the alignment pin 260 is operable to guide the bushing member 224 onto the element cover 222 in the desired and proper orientation. Additionally, the element cover 222 includes a receptacle 26 defining an aperture, such that a size and a shape of the receptacle 26 corresponds to a size and a shape of the alignment pin 260.

During the manufacture of the electric water heater 12, the external reset device 20 is assembled such that the aperture 65 of the element cover 22 is aligned over the reset button 54 of the control device 18. The reset button 54 is aligned with an axis defined by the bushing aperture 34. Additionally, the control device 18 is in the OPEN position to prevent the occurrence of dry start by impeding the operation of the heating elements 16 until the reset button 54 is depressed.

During installation of the electric water heater 12, the electric water heater 12 is first electrically connected to the household power supply. The water heater tank is then filled with an initial charge of water. After the initial charge of water has been introduced into the water heater 12, the installer detaches the key member 26 from the bushing member 24 which breaks the thin neck portion 25. Without removing the element cover 22, the key member 26 is inserted into the bushing member 24. As the extension portion 44 of the key member 26 is inserted into the column portion 30 of the bushing member 24, the extension portion 44 pierces the first film cover 40*a* that is placed over the top portion 28. Continued insertion of the key member 26 depresses the reset button 54 of the control device 18, returning it to the normally CLOSED position. With the control device 18 reset to the normally CLOSED position, the heating elements 16 are operable to heat the water contained in the electric water heater 12.

In addition to various aspects of the present invention that have been disclosed, it should be appreciated that variations may be made without departing from the scope of the present invention. For example, the bushing member 24 may include a snap-and-lock feature and/or device, a twist-and-lock feature and/or device, a locking device, a clipping device or any combination thereof, to hold and maintain the bushing member 24 in position and/or orientation after the bushing member 24 is connected to the electric water heater 12. In order to position the bushing member 24 in a desired and proper orientation, the bushing member 24 may include multiple aligning pins, a notch on the bushing member 24 to set within a recess located on the element cover 22, a snap-and-lock feature, a twist-and-lock feature, or the column portion 30 having a combination geometric shape (e.g., a triangle side and a circle side) or any single geometric shape. Moreover, the aligning pin 260 may be located anywhere on the bushing member 24. Positioning of the aligning pin 60 may be horizontal or vertical to a surface of the bushing member 24. Furthermore, the external reset device 20 may comprise a plastic or metal material.

Moreover, in regard to the bushing member 24, the top portion 28 may comprise any geometric shape or any combination of multiple geometric shapes. Furthermore, the control device 18 may comprise a multi-position switch, wherein separate sets of contacts may be used for multiple circuits. Moreover, various materials have been disclosed in an exemplary fashion; however, other materials may, of course, be employed, although some of the advantages of the present invention may not be realized. It is intended by the following claims to cover these and any other departures from the disclosed embodiments that fall within the true spirit of the invention.

What is claimed is:

1. An electric water heater comprising:

at least one heating element operative to heat water within the electric water heater;

a control device electrically connected to the at least one heating element and comprising a resettable switch having a normally CLOSED position and an OPEN position, wherein in the CLOSED position the control device enables power to the at least one heating elements and in the OPEN position the control device disables power to the at least one heating element;

an element cover coupled to the water heater and comprising a first aperture, wherein the element cover is adapted to cover the control device such that the first aperture is aligned with the resettable switch; and an external reset device coupled to the element cover and comprising a bushing member and a key member, wherein the bushing member comprises a second aperture aligned with the resettable switch, and wherein the key member is adapted for inserting into the bushing member and resetting the resettable switch to the CLOSED position.

2. The electric water heater of claim 1 further comprising a protective shield connected to the control device and comprising a third aperture enabling access to the resettable switch, wherein the protective shield is configured for covering electrical connections of the electric water heater to prevent unintended contact with the electrical connections.

3. The electric water heater of claim 1, wherein the bushing member further comprises a film covering coupled to a surface of the bushing member.

4. The electric water heater of claim 1, wherein the external reset device is further operative to reset the control device without removing the element cover.

5. The electric water heater of claim 1, wherein the bushing member further comprises at least one clip adapted to hold and maintain the bushing member in a desired position while coupled to the element cover.

6. The electric water heater of claim 1, wherein the bushing member having a column with an outer parameter shaped to direct the bushing member into a proper orientation when coupled to the electric water heater.

7. The electric water heater of claim 1, wherein the bushing member further comprises an alignment pin adapted to guide the bushing member into a proper orientation as the bushing member is coupled to the element cover.

8. An external reset device for resetting a control device of an electric water heater having an initial charge of water, wherein the control device is configured to prevent power from being supplied to at least one heating element within the electric water heater to heat the water comprising:

a bushing member adapted to be coupled to a first aperture of an element cover that is mounted onto an exterior surface of the electric water heater while concealing the control device and comprising a second aperture, wherein the bushing member is position adjacent to the first aperture of the element cover such that the second aperture is aligned with the control device; and a key member removably coupled to the bushing member, wherein the key member is configured for insertion into the second aperture of the bushing member to depress a mechanism on the control device to enable the at least one heating element to powered ON and heat the water within the electric water heater.

9. The external reset device of claim 8, wherein the bushing member further comprises at least one clip adapted to hold and maintain the bushing member in a desired position while coupled to the element cover.

10. The external reset device of claim 9, wherein the at least one clip is configured to flex inward as the bushing member is inserted into the first aperture of the element cover and flex outward when the bushing member is in the desired position.

11. The external reset device of claim 8, wherein the bushing member further comprises an alignment pin adaptive to guide the bushing member into a proper orientation as the bushing member is coupled to the element cover.

12. The apparatus of claim 8, wherein the bushing member having a column with an outer parameter shaped to direct the bushing member into a proper orientation when coupled to the electric water heater.

13. The apparatus of claim 11, wherein the outer parameter of the column has at least one of a hexagonal or cylindrical shape.

14. The apparatus of claim 8, wherein the key member is inserted into the bushing member for a period of time in order to reset the control device.

15. A method of installing an electric water heater comprising:

connecting electrically an electric water heater to a house power supply;

filling the water heater with an initial charge of water;

detaching a key member from a bushing member which is located adjacent to an element cover of the water heater; and, inserting the key member into the bushing member to reset a control device having a resettable switch from a OPEN position to a normally CLOSED position to allow electrical energy to flow into an electrical circuit having at least one heating element that is operable to heat the initial charge of water without removing the element cover from the water heater.

16. The method of claim 15, wherein inserting the key member further comprises: piercing through at least one film cover located adjacent to the bushing member as the key member is inserted into the bushing member.

17. The method of claim 16, wherein piercing through the at least one film cover further comprises: piercing through the at least one film cover that is placed over a top portion of the bushing member.

18. The method of claim 16, wherein piercing through the at least one film cover further comprises: piercing through the at least one film cover that is placed over a bottom portion of the bushing member.

19. The method of claim 15, wherein inserting the key member further comprises pushing a reset button associated with the resettable switch to allow the electrical energy to flow into the electrical circuit having the at least one heating element.

* * * * *